United States Patent [19]

Loverro, Jr.

[11] Patent Number: 4,701,227

[45] Date of Patent: Oct. 20, 1987

[54] AMMONIUM NITRATE EXPLOSIVE COMPOSITIONS

[76] Inventor: Nicholas P. Loverro, Jr., 318 Brigette Ct., Redlands, Calif. 92374

[21] Appl. No.: 11,086

[22] Filed: Feb. 5, 1987

[51] Int. Cl.[4] ..... C06B 31/32

[52] U.S. Cl. ..... 149/47; 149/46; 149/6 D; 149/61; 149/62; 149/88; 149/92; 149/109.6

[58] Field of Search ..... 149/46, 47, 60, 61, 149/62, 88, 92, 109.6

[56] References Cited

U.S. PATENT DOCUMENTS

| | | | |
|---|---|---|---|
| 3,783,053 | 1/1974 | Oettmeier et al. | 149/41 |
| 3,899,374 | 8/1975 | Sylkhouse | 149/2 |
| 4,124,368 | 11/1978 | Boyars | 71/59 |
| 4,263,069 | 4/1981 | Reed et al. | 149/9 |
| 4,300,962 | 11/1981 | Stinecipher et al. | 149/47 |
| 4,353,758 | 10/1982 | Akst et al. | 149/109.6 |
| 4,357,184 | 11/1982 | Binet et al. | 149/2 |
| 4,419,155 | 12/1983 | Wagamann et al. | 149/109.6 |
| 4,421,578 | 12/1983 | Voreck, Jr. | 149/2 |
| 4,528,049 | 7/1985 | Udy et al. | 149/21 |

*Primary Examiner*—Stephen J. Lechert, Jr.

*Attorney, Agent, or Firm*—Charles E. Bricker; Donald J. Singer

[57] ABSTRACT

The shock sensitivity of explosives based on ammonium nitrate can be decreased by adding thereto a desensitizing amount of a polyethyleneimine or a polyethyleneimine polynitrate.

20 Claims, No Drawings

AMMONIUM NITRATE EXPLOSIVE COMPOSITIONS

RIGHTS OF THE GOVERNMENT

The invention described herein may be manufactured and used by or for the Government of the United States for all governmental purposes without the payment of any royalty.

BACKGROUND OF THE INVENTION

This invention relates to explosives, particularly explosive compositions based upon ammonium nitrate.

Traditional general-purpose explosives comprise trinitrotoluene (TNT), which has several disadvantages. It is a Class-A explosive, requiring special mixing and handling procedures and storage facilities, all accordingly increasing the cost of use. The preparation of this explosive is through nitrate substitution of toluene by a mixed acid consisting of concentrated nitric acid and sulphuric acid. The cost of concentrated nitric acid is moderately expensive and the excess nitric acid in the product destabilizes the explosive and presents corrosion problems. Trinitrotoluene is not water soluble and bomb disposal cannot be done economically by steam or hot water.

A binary mixture of ethylenediamine dinitrate (EDDN) and ammonium nitrate (AN) is water soluble, thereby having several advantages over trinitrotoluene such as safer storage as a non-explosive water solution and cheaper disposal. However, the binary mixture has a high melting point, has stability problems, and is expensive.

Recently potassium nitrate has been added to improve the stability of the mixture. The problems associated with the binary mixture remain and the amount of chloride impurities is increased by the additional chloride impurities found in potassium nitrate (KN). If these impurities are not removed, the explosive has serious corrosion problems, and if the impurities are removed the cost of the explosive increases greatly. The present method of making the ternary mixture is to mix solid ethylenediamine dinitrate, ammonium nitrate and potassium nitrate. Ethylenediamine dinitrate is not commercially available in large quantities and is expensive. Industrial grade ammonium nitrate and potassium nitrate are too impure to be used without the additional expense of purification. Dry mixing three explosives to form an explosive mixture requires special procedures and precautions, causing the cost of the process to increase significantly.

Other explosives compositions based upon ammonium nitrate include AN/fuel oil, AN/TNT/RDX (cyclotrimethylenetrinitromine), AN/ammonium salt of a nitroazole/RDX, AN/EDDN/DN/NQ (nitroguanidine) and the like.

It is known that ammonium nitrate is a hazardous material to manufacture on an industrial scale, to handle in large amounts, and to store in great masses, especially for relatively long periods of time. It is also known that the shock sensitivity of ammonium nitrate increases seriously after exposure to a few temperature cycles through the 32.3° C. (90° F.) transition point. (Up to 32.3° C. the stable crystal form is orthorhombric bipyramidal; from 32.3° C. to 84° C. the stable crystal form is orthorhombic).

Explosive compositions based upon ammonium nitrate are often hazardous to handle and store, just as is ammonium nitrate alone. What is desired is a desensitizer for explosive compositions based upon ammonium nitrate.

Accordingly, it is an object of the present invention to provide a method for desensitizing explosive compositions based upon ammonium nitrate.

Another object of this invention is to provide a modified composition of ammonium nitrate, ethylene diamine dinitrate and potassium nitrate which is less sensitive to accidental ignition or detonation than the unmodified composition.

Other objects, aspects and advantages of the invention will be apparent to those skilled in the art from a reading of the following detailed disclosure of the invention.

SUMMARY OF THE INVENTION

In accordance with the present invention there is provided a method for desensitizing explosive compositions based upon ammonium nitrate which consists essentially of incorporating a desensitizing amount, generally about 0.5 to 15 weight percent, of a polyethyleneimine (PEI), preferably having an average molecular weight of about 10,000 to greater than 60,000, into the explosive composition.

In accordance with another aspect of the invention, there is provided a method for desensitizing explosive compositions based upon ammonium nitrate which consists essentially of treating a polyethyleneimine having an average molecular weight of about 10,000 to greater than 60,000 with nitric acid to form the salt polyethyleneimine polynitrate, recovering the polynitrate salt, and incorporating a desensitizing amount, generally 0.5 to 15 weight percent, of the polynitrate salt into the explosive composition.

Further, in accordance with the present invention, there are provided explosive compositions consisting essentially of ammonium nitrate, ethylenediamine dinitrate, potassium nitrate and a stabilizing amount of either polyethyleneimine or the polynitrate salt thereof.

DESCRIPTION OF THE INVENTION

Polyethyleneimine (PEI) is a highly branched polymer having the general formula $$H_2N(CH_2CH_2NR)_xH$$

wherein x is an integer representing the number of repeating units in the polymer and R is —H or $—CH_2CH_2NR_2$. PEI is available commercially from Cordova Chemical Company, North Muskegon, Mich. in a variety of molecular weights under the trademark "Corcat". One such polymer "Corcat P-150" available in 33 wt% aqueous solution has an average molecular weight of 10,000 and a viscosity at 25° C. of less than 1000 cp; another polymer "Corcat P-600" available in 33 wt% aqueous solution has an average molecular weight greater than 60,000 and a viscosity of 25° C. of less than 5000 cp. The branched structure of these polymers may be represented as follows:

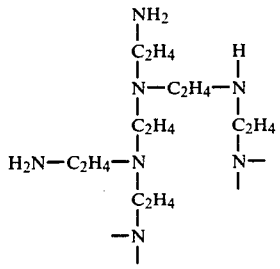

Because the structure is so highly branched, the aforementioned general formulae are, at best, somewhat speculative as well as being self-referential. In general, these polymers comprise about 30% primary, 40% secondary and 30% tertiary amine linkages.

Polyethyleneimine polynitrate (PNEI) can be prepared by treating PEI with excess nitric acid. The nitration may be carried out, quite simply, by slowly adding nitric acid, with stirring, to an aqueous solution of PEI until the solution becomes acidic. The polynitrated salt is then isolated by pouring the aqueous solution into excess, cold acetone or other non-solvent for the salt, followed by filtration. The product salt should be washed with acetone, then vacuum dried. The product is hygroscopic and should be stored under anhydrous conditions.

The PEI or PNE is incorporated into the ammonium nitrate-based explosive composition in any suitable manner. Many ammonium nitrate-based explosive compositions are formulated as melts, then cast. Accordingly, a preferred method for incorporating the PEI or PNEI is to add the PEI or PNEI to the melt. For example, the eutectic explosive composition EAK may be prepared by melting 46 wt% ethylenediamine dinitrate, 46 wt% ammonium nitrate and 8 wt% potassium nitrate in a suitable vessel at about 105° C. When the material is molten and well mixed, PEI may be added to the vessel with adequate stirring to assure complete mixing. Depending on the grade of PEI used, it may be added as either a neat liquid or in aqueous solution. The amount of PEI added to the EAK melt can range from about 0.5 to 15 wt%, based on the weight of EAK.

When PEI is added to the ammonium nitrate-based composition, ammonia is evolved. After all the PEI has been added to the melt, vacuum is applied to the vessel and its contents while maintaining the temperature above the melting point of the melt for a time sufficient to strip off evolved ammonia plus any water which may be present. A vacuum of about 1 inch of mercury or less is desirable. Without wishing to be limited to any particular theory, it appears that the evolved ammonia results from proton exchange between the PEI and the ammonium ions in the melt.

Where PNEI is used in place of PEI little, if any, ammonia is evolved from the melt. A longer stirring time may be required to dissolve the PNEI into the melt. When the PNEI is dissolved, vacuum may be applied to the vessel and its contents, as described above, to ensure removal of ammonia and/or water.

The explosive composition is then flaked by a chiller belt, packaged and shipped, or cast into molds.

The following example illustrates the invention:

EXAMPLE

A series of compositions of EAK without and with various amounts of PEI (Corcat P-150) were prepared, the latter being prepared by stirring PEI into the EAK and stripping ammonia and water therefrom under vacuum as described previously.

The EAK was a eutectic mixture of 46 wt% EDD, 46 wt% AN and 8 wt% KN. The EDD was made by neutralizing ethylenediamine in ethanol solution with nitric acid. The AN and KN were reagent grade commercial products.

Differential scanning calorimetric data for the various compositions are given in table I, below:

TABLE I

| Formulation | Onset (°C.) | Point (°C.) | Exotherm (°C.) | Major Exotherm Peak (°C.) |
|---|---|---|---|---|
| EAK | 96 | 103.5–106 | 235 | 248 |
| EAK + 2% PEI | 99 | 104–110 | 235 | 255 |
| EAK + 5% PEI | 84 | 103.5–118 | 240 | 261 |
| EAK + 10% PEI | 86 | 105–122 | 240 | 272 |
| EAK + 15% PEI | 94 | 99–125 | 240 | 275 |

Various test data comparing EAK vs. EAK+2% PEI are given in Table II, below. Except as noted below, the following tests are set forth in "Naval Weapons Center Safety and Performance Tests for Qualification of Explosives" (NAVORD OD-44811, Vol. 1).

TABLE II

| Test | EAK | EAK + 2% PEI |
|---|---|---|
| Impact Sensitivity, Type 12 | 80 cm | 90 cm |
| Henkin, critical temp. (°C.) | 249 | 257 |
| Chemical Reactivity (cc/22 hr/120° C.) | 0.02 | 0.07 |
| Tensile Strength (max) | 408 psi | 70 psi |
| Friction Sensitivity* | No reaction | No reaction |
| Electrostatic sensitivity | No reaction | No reaction |

*Picatinny Arsenal Friction Sensitiveness Test (fiber shoe)

Various modifications may be made without departing from the spirit of the invention or the scope of the appended claims.

I claim:

1. A method for desensitizing explosive compositions based upon ammonium nitrate which consists essentially of incorporating a desensitizing amount of a polyethyleneimine into said composition.

2. The method of claim 1 wherein said desensitizing amount is about 0.5 to 15 weight percent.

3. The method of claim 1 wherein said polyethyleneimine has an average molecule weight of about 10,000 to greater than 60,000.

4. The method of claim 1 wherein said explosive composition is a eutectic mixture of 46 wt% ammonium nitrate, 46 wt% ethylenediamine dinitrate and 8 wt% potassium nitrate.

5. The method of claim 4 wherein said polyethyleneimine has an average molecular weight of about 10,000.

6. The method of claim 4 wherein the amount of said polyethyleneimine is 2 wt percent.

7. The method of claim 5 wherein the amount of said polyethyleneimine is 5 wt. percent.

8. A method for desensitizing explosive compositions based upon ammonium nitrate which consists essentially of incorporating a desensitizing amount of a polyethyleneimine polynitrate into said composition.

9. The method of claim 8 wherein said desensitizing amount is about 0.5 to 15 weight percent.

10. The method of claim 8 wherein said polyethyleneimine polynitrate is derived from a polyethyleneimine having an average molecular weight of about 10,000 to greater than 60,000.

11. The method of claim 8 wherein said explosive composition is a eutectic mixture of 46 wt% ammonium nitrate, 46 wt% ethylenediamine dinitrate and 8 wt% potassium nitrate.

12. An explosive composition consisting essentially of an explosive based upon ammonium nitrate and a desensitizing amount of a polyethyleneimine.

13. The composition of clainm 12 wherein said desensitizing amount is about 0.5 to 15 wt percent based upon the weight of said explosive.

14. The composition of claim 13 wherein said explosive is a mixture of ammonium nitrate, ethylenediamine dinitrate and potassium nitrate.

15. The composition of claim 14 wherein said mixture is a 46:46:8 mixture.

16. The composition of claim 15 wherein the amount of said polyethyleneimine is about 2 wt percent.

17. An explosive composition consisting essentially of an explosive based upon ammonium nitrate and a desensitizing amount of a polyethyleneimine polynitrate.

18. The composition of claim 17 wherein said desensitizing amount is about 0.5 to 15 wt percent based upon the weight of said explosive.

19. The composition of claim 18 wherein said explosive is a mixture of ammonium nitrate, ethylenediamine dinitrate and potassium nitrate.

20. The composition of claim 19 wherein said mixture is a 46:46:8 mixture.

* * * * *